United States Patent [19]

Wright

[11] 4,078,997

[45] Mar. 14, 1978

[54] SEPARATION APPARATUS

[76] Inventor: Douglas Charles Wright, 14 Pacific Drive, Banora Point, New South Wales, Australia, 2413

[21] Appl. No.: 719,691

[22] Filed: Sep. 2, 1976

Related U.S. Application Data

[63] Continuation of Ser. No. 334,567, Feb. 22, 1973, abandoned.

[51] Int. Cl.[2] ..... B03B 5/26

[52] U.S. Cl. ..... 209/458; 209/493

[58] Field of Search ..... 209/471, 477, 479, 483, 209/438, 443, 458, 459, 490, 493

[56] References Cited

U.S. PATENT DOCUMENTS

| | | | |
|---|---|---|---|
| 189,928 | 4/1877 | Evans | 209/458 |
| 1,621,022 | 3/1927 | Merchen | 210/91 X |
| 3,000,502 | 9/1961 | Hobart | 209/458 |

*Primary Examiner*—Frank W. Lutter
*Assistant Examiner*—Ralph J. Hill
*Attorney, Agent, or Firm*—Haseltine, Lake & Waters

[57] ABSTRACT

A separating apparatus and method is provided by the use of which a stratified flow of a mixture of materials of different properties, for example, a slurry of mineral-bearing sand in water, can be separated into fractions by impinging a substantial proportion of the flow against a separator face assembly, for example, a separator plate.

2 Claims, 4 Drawing Figures

SEPARATION APPARATUS

CROSS-RELATED APPLICATION

This application is a continuation of co-pending application 334,567 filed Feb. 22, 1973 and now abandoned.

This invention relates to a method and apparatus for separating mixtures of materials having different properties into their constituent components by utilizing induced stratification. More particularly the invention is concerned with the separation of granular mixtures, for example, ores in slurries, particularly aqueous slurries, into separated portions or strata, one of which contains the major portion of the valuable mineral, while another contains so little valuable mineral that it may be economically discarded.

The invention may be employed in a wide range of applications, for example, the upgrading of iron ores, coal washing, preconcentration of ores prior to flotation, and the recovery of valuable minerals from mine tailings. It is particularly applicable to heavy mineral-bearing sands, such as sands containing ilmenite, rutile, zircon, cassiterite, monazite, gold, platinum, chromite and like minerals.

Many different types of apparatus such as pinched sluices, cones, jigs, spirals and tables have and are being used for the separation of heavy minerals.

A commonly used sluice tray includes a forwardly and downwardly inclined bottom from which is upstanding a pair of spaced walls which converge forwardly to a discharge outlet. Adjacent and upstream of the discharge outlet there is provided an opening or slot in the bottom of the tray extending transverse to the direction of motion of the slurry or "pulp". The pulp is fed down the sluice tray and certain minerals report to various levels in the pulp. The level reached depends on a number of factors such as size and specific gravity of the mineral particles and the gangue, pulp density of the slurry, depth of pulp and length of travel of the slurry.

The distance between the start of the tray and the slot in the bottom of the tray is so selected that some of the desired mineral passes through the slot for collection while the remainder of the pulp flows over the slot and out through the discharge outlet. It is thought that a number of factors have a bearing on the efficiency of sluice trays of the above type, for example, the angle of the tray bottom with respect to the horizontal, nature of raw material to be treated, density of the pulp, feed rate and length of travel of the pulp.

Often, a number of trays are used in a line, or "coupled", with the discharge outlet of an upper tray feeding the next lower tray. In such arrangements the distance between the start of the tray and its slot may vary from tray to tray, the dimensions of the slots may vary and the trays may each be at different inclinations. It has been found that the separation characteristics of these coupled trays vary from tray to tray and various attempts have been made to overcome this problem. Trays may be provided with side walls which may be adjusted as to their convergence and, as mentioned above, the trays may be set at different angles to the horizontal, but this expedient has not been particularly successful.

In another known apparatus, a series of cones are stacked one above the other. Pulp is directed onto the apex of the uppermost cone and flows from there to its circumference and is directed downwards onto an inverted concentrating deck. Pulp flows towards the axis of the stack near which an annular slot is located. Some of the desired mineral passes through the slot for collection while the remainder of the pulp flows over the slot and out through the discharge outlet and is then directed onto the next cone. A variation from this embodiment is to have two concentric slots spaced approximately four inches apart on the concentrating deck for increasing the amount of solids taken into concentrates.

In the present specification and claims all percentages are by weight.

In one example of a process carried out according to the prior art, for a very low feed rate of 2.5 to 3.0 tons per hour per foot of width over a parallel sluice 7 feet long with a slot gap 1 to 1½ wide, approximately 40% only of the solids were taken through the slot. When the feed rate was increased above 3 tons per hour the percentage of solids passing through the slot decreased.

In another example, using a cone at a feed rate of 61 tons per hour, approximately 54% of the solids were taken through the slot into concentrates. When the feed rate was increased to approximately 95 tons per hour, only 48% of the solids passed through the slot. There was a corresponding decrease from 87% heavy mineral recovered to 76% heavy mineral recovered respectively.

The present invention is based on research into the behaviour of such equipment and methods.

It was discovered, for example, that there was a hitherto unrecognized consistent relationship between the percentage of solids taken into concentrates through the slot or slots in gravity separation equipment such as cone assemblies and pinched sluices and the percentage of heavy mineral recovered therefrom.

The aforementioned gravity separation equipment can achieve a high recovery of heavy mineral up to certain feed rates only. The recovery of heavy mineral declines markedly as the feed is increased beyond certain rates. It is commonly believed that the equipment has become "overloaded". It was found that the decline in recovery of heavy mineral was in most cases not due to an apparent overload of feed but was due to the inability of the slot to take through a constant percentage of solids. As the feed rate increased the solids passing through the slot became a decreasing percentage of the feed with a resultant decline in the percentage recovery of heavy mineral.

It was also discovered that for rutilebearing mineral sands a percentage of solids (for example, 70%) could be selected and taken through a slot so that a very high proportion, for example, 98% to 99% by weight of rutile was recovered. Furthermore, a high proportion, for example, 30% by weight, of the lighter silica sand containing little valuable mineral could be rejected at the same time.

It is therefore an object of this invention to provide an apparatus for separating from a stream of slurry any given percentage of solids over a wide range.

It is another object of this invention to provide apparatus for separating from a stream of slurry a selected percentage of solids over a wide range of feed rates.

It is another object of this invention to provide apparatus for separating from a stream of slurry a selected percentage of solids over a wide range of feed rates which apparatus requires little or no adjustment.

It is another object of this invention to provide an apparatus for separating from a stream of slurry a selected percentage of heavy minerals.

It is another object of this invention to provide apparatus for separating from a stream of slurry a selected percentage of heavy minerals over a wide range of feed rates which apparatus requires little or no adjustment.

It is another object of this invention to provide apparatus for separating from a stream of slurry a selected percentage of heavy mineral over a wide range of feed rates.

It is another object of this invention to provide an apparatus for separating material of different densities from slurries containing such material.

It is another object of this invention to provide an apparatus for separating material of different densities from slurries containing such material over a wide range of feed rates which apparatus requires little or no adjustment.

It is another object of this invention to provide a method of separating such materials.

It is another object of this invention to provide a method of separating such materials over a wide range of feed rates.

It is another object of this invention to provide a method of achieving a high recovery of heavy mineral using known gravity separation equipment such as cones and pinched sluices, at feed rates considerably higher than the present art permits.

It is also an object of this invention to outline a method of separating heavy particles from a bed of composite material by selectively discharging the heavy particle deplenished portion of the composite bed and recycling the heavy particle enriched portion of the composite bed of material.

Accordingly, this invention provides an apparatus for separating materials having different properties from mixtures of such materials, which comprises a flow guide assembly and a separator face assembly, the guide assembly being adapted to direct a flow of stratified mixture against the face assembly, said face assembly being arranged at such an angle to the direction of flow whereby upon impingement against the face assembly the mixture is separated into fractions, one fraction passing to a first collector means and the other fraction passing to a second collector means.

This invention also provides an apparatus for separating materials having different densities from slurries of such materials, which comprises a flow guide assembly and a separator face assembly, the guide assembly being adapted to direct a flow of gravity-stratified slurry against the face assembly, said face assembly being arranged at such an angle to the direction of flow whereby upon impingement against the face assembly the slurry is separated into fractions, one fraction passing downwardly to a first collector means and the other fraction passing upwardly to a second collector means.

In order that the invention may be more readily understood and put into practical effect reference will now be made to some of the preferred forms of the invention.

The face assembly is preferably arranged substantially normal to the direction of flow but may be varied above and below 90°.

The guide assembly is preferably in the form of a sluice or sluice tray.

The face assembly may take any suitable form, for example, it may be formed by the upstanding downstream face of a slot in the floor of a sluice. Alternatively, it may take the form of a flat, generally rectangular separator plate. However, it may be found desirable, for example, to curve it in one or other direction or bend it at an angle to alter the direction of flow of one or both of the streams of separated material.

When, according to the invention, a sluice is used in conjunction with a flat, generally rectangular plate, the plate is preferably formed separately from the sluice and spaced from it. The separating plate in this case is preferably arranged between prolongations of the sidewalls of the sluice.

Alternatively, the guide assembly may take the form of an inverted, truncated cone, the face assembly preferably being formed by an annulus arranged coaxially therein. The annulus preferably has an outer bevelled face. The annulus may be bevelled to provide a sloping face ending in either an edge or a flat top. Alternatively a number of faces, sloping at different angles, may be bevelled on the annulus, in which case the annulus is preferably movable axially within the truncated cone providing a selection of faces towards the flow.

It is preferable that the face assembly be hinged around its horizontal axis so that its angle of attack to the stream can be altered, as desired, from the normal. This angle of the face assembly to the direction of the flow of the slurry is the principal factor which can be varied to obtain a desired efficiency of separation. Furthermore, in the case of a face assembly for a cone the face assembly may be constructed such that the same variation in angle can be obtained, for example, as explained above, as an annulus, with alternative outer bevelled faces movable axially within the cone.

In another embodiment according to the invention the face assembly is inclined towards the base of the sluice, forming an acute angle therewith, and the edge of the upstream face of the slot is curved downwards. This curvature directs the moving pulp bed towards the downstream separating face so that the lower portion is deflected downwardly through the slot while the upper half is directed upwardly towards the outlet from the sluice.

Yet again, the face assembly may be adjustable in a generally vertical direction either up or down so that it can handle different depths of flow of slurry.

Stratification of the mixture may be achieved by utilizing gravity only as the mixture flows through the guide assembly. However, stratification could be obtained, or assisted, by any other suitable means, for example, by centrifuging or the action of a magnetic field.

This invention also provides a method of separating materials having different properties from mixtures of such materials, which comprises the steps of directing a flow of stratified mixture against a separator face assembly, said face assembly being arranged at such an angle to the direction of flow whereby upon impingement against the face assembly the mixture is separated into fractions, and collecting separately the fractions of separated materials.

This invention further provides a method of separating materials of different densities from a slurry of such materials, which comprises the steps of directing a flow of gravity-stratified slurry against a separator face assembly, said face assembly being arranged at such an angle to the direction of flow whereby upon impingement against the face assembly the slurry is separated into fractions, and collecting separately the fractions of materials of different densities.

Furthermore, this invention provides a method of separating heavy minerals from rutile-bearing sands, which comprises directing a gravity-stratified flow of a slurry of such rutile-bearing sand in water against a separator plate arranged at an angle to the direction of flow and collecting separately a fraction of material containing from 50% to 80% solids flowing downwardly from such separator plate and rejecting the fraction flowing upwardly from the plate.

Preferably, this separation step is repeated at least four times to obtain a final product comprising from 25% to 30% of the original rutile-bearing sand containing up to 97% of the rutile.

Furthermore, a generally horizontal flow of slurry could be split and the downwardly flowing fraction again split using a second separator plate. Any suitable combination of streams and separator plates could be used.

It is possible, and usually desirable, to provide a bank of sluices and separator plates. For example, if it is desired to obtain a recovery of approximately 97% by weight of the rutile in a heavy mineral bearing sand, in about 30% by weight of the original material, this could be achieved using a bank of four sluices and separating plates.

Finally, this invention relates to a separator face assembly which comprises adjustable support means and at least one face adapted to separate materials having different properties from mixtures of such materials upon impingement against the face assembly of a flow of such a mixture.

Referring now to the first collector means, this can take any suitable form. In the case of a sluice having a separator plate arranged according to the invention, the lighter fraction sprays upwardly from the plate. The first collector means may, therefore, take the form of a trough having a lower outlet. This trough may be partly covered over by a hood. The trough is suitably arranged at right angles to the direction of flow of the fraction.

The angle of impingement will determine the percentage of the material which deflects in either of the flow directions.

In the case of a slurry, the face assembly is preferably in the form of a flat, generally rectangular separator plate hinged between the prolongations of the sidewalls of the sluice, the prolongations being parallel for preference. If so desired for any purpose, the face assembly may be turned so that all, or a proportion, for example, the lower 20%, of the feed slurry is deflected through the slot between the end of the sluice and the face assembly. Alternatively, the face assembly may be turned in a generally opposite direction so that all, or a proportion, of the feed slurry is deflected over the face assembly. Hence, the angle of the face assembly to the direction of the flow of the slurry may be varied to any angle so that it impinges upon any given percentage of solids in the feed slurry, the remainder being passed over or under the face assembly, without the separating action taking place. A locking device may be used to fix the face assembly at any desired angle.

However, it is desirable that substantially the full stream of slurry should strike the plate. This permits a constant percentage of solids with its related percentage of heavy mineral to be taken into the concentrates notwithstanding considerable variations in feed rates.

Without wishing to be bound by any theory, it is thought that the improvements provided by the present apparatus and method over the prior art may be due to the factors discussed below:

The flow of mixture to the separator face assembly should be stratified. It is, of course, desirable that the flow should be laminar rather than turbulent but the essential factor is the stratification of materials of different properties. Although for some purposes it may be desirable to allow some of the flow not to impinge upon the separator face assembly, a substantial porportion of the flow must impinge upon the face assembly, if separation of the efficiency contemplated by the present invention is to occur. Furthermore, it is clear that the flow rate of the mixture should be sufficiently high that separation will occur. Finally, the principal separation should take place at the separator face assembly and not before.

One embodiment of an apparatus according to the invention is described in detail below with reference to the accompanying drawings.

Figure 1:
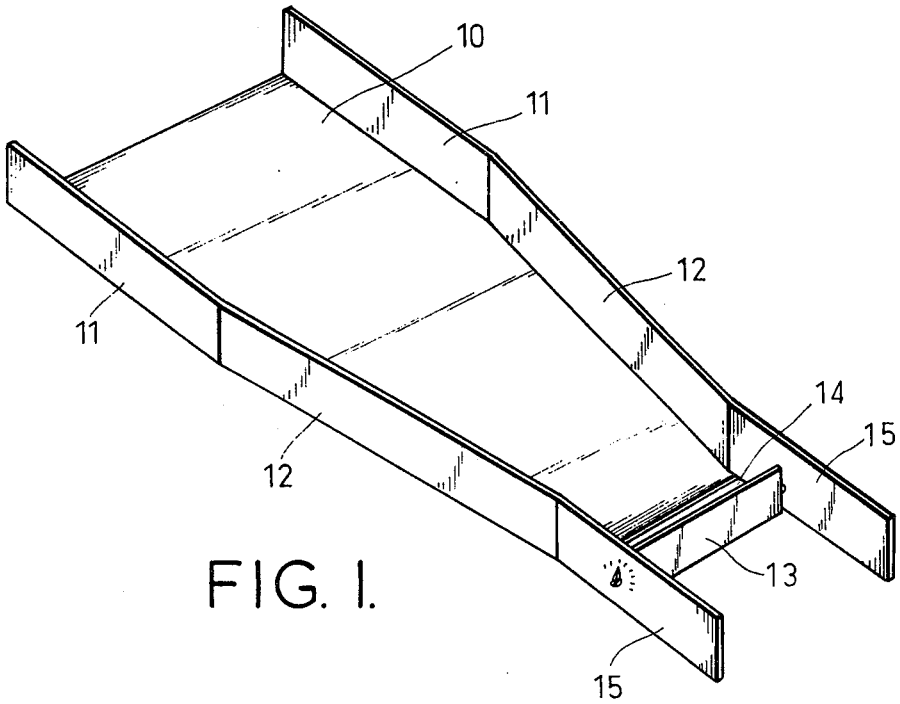
FIG. 1 is a perspective view from one side of the apparatus.

In FIG. 1, base 10 of a sluice is bounded by upstanding walls 11 having converging sections 12. A hinged separator plate 13 is spaced from the end of base 10 by a gap or slot 14. Parallel prolongations 15 of the walls 12 are also shown.

Figure 2:
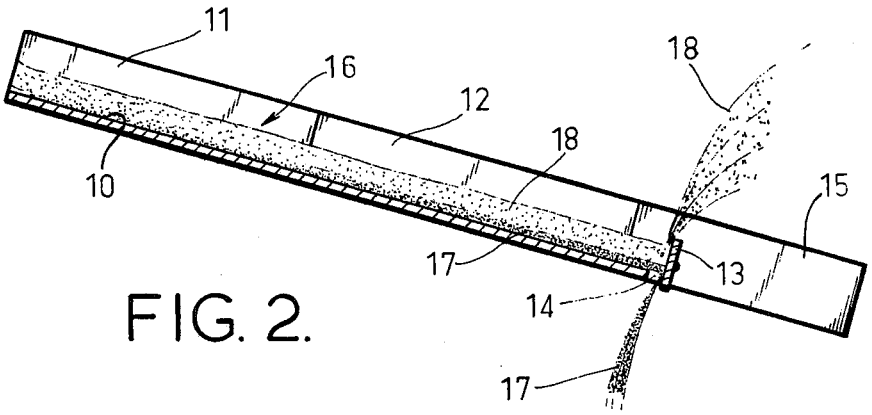
FIG. 2 is a cross-sectional view from the same side of the apparatus, showing the apparatus in operation.

In FIG. 2, numeral 16 indicates a bed of slurry generally. Silica sand layers 18 overlie heavy mineral layers 17 and are separated by the separator plate 13.

Certain embodiments according to the invention are described in detail in the Examples below.

EXAMPLE 1

In this example, the raw material used was a rutile-bearing mineral sand obtained from Stradbroke Island, Queensland, Australia. A pinched sluice was used as illustrated in FIGS. 1 and 2 of the accompanying drawings described in detail above.

The sluice was approximately 5 feet 6 inches long, the feed end of the sluice about 14" wide, the gap about 1 inch wide and the separating plate about 9" wide.

The results of a series of tests are set out in Table "A" below.

TABLE "A"

| | % Solids Taken | % Heavy Mineral Recovered | % Rutile Recovered | % Zircon Recovered | % Magnetics Recovered | % Others Recovered | Head* Feed Grade | Tons Per Hour |
|---|---|---|---|---|---|---|---|---|
| 1 | 55.63 | 92.51 | 96.14 | 97.55 | 91.78 | 77.97 | 3.32 | 6.06 |
| 2 | 61.39 | 95.26 | 97.55 | 97.97 | 94.88 | 84.88 | 3.50 | 6.17 |
| 3 | 64.10 | 95.53 | 98.12 | 98.45 | 95.28 | 84.57 | 3.16 | 6.05 |
| 4 | 69.66 | 97.11 | 99.03 | 98.99 | 96.59 | 90.70 | 3.55 | 6.29 |
| 5 | 70.65 | 97.42 | 98.90 | 99.39 | 97.09 | 92.77 | 2.77 | 5.86 |
| 6 | 72.79 | 97.13 | 98.86 | 99.31 | 96.64 | 95.23 | 2.08 | 6.18 |

TABLE "A"-continued

| | % Solids Taken | % Heavy Mineral Recovered | % Rutile Recovered | % Zircon Recovered | % Magnetics Recovered | % Others Recovered | Head* Feed Grade | Tons Per Hour |
|---|---|---|---|---|---|---|---|---|
| 7 | 80.89 | 98.38 | 99.45 | 99.28 | 98.06 | 94.54 | 2.98 | 5.55 |

*that is, % age of heavy mineral in head feed

Figure 3:
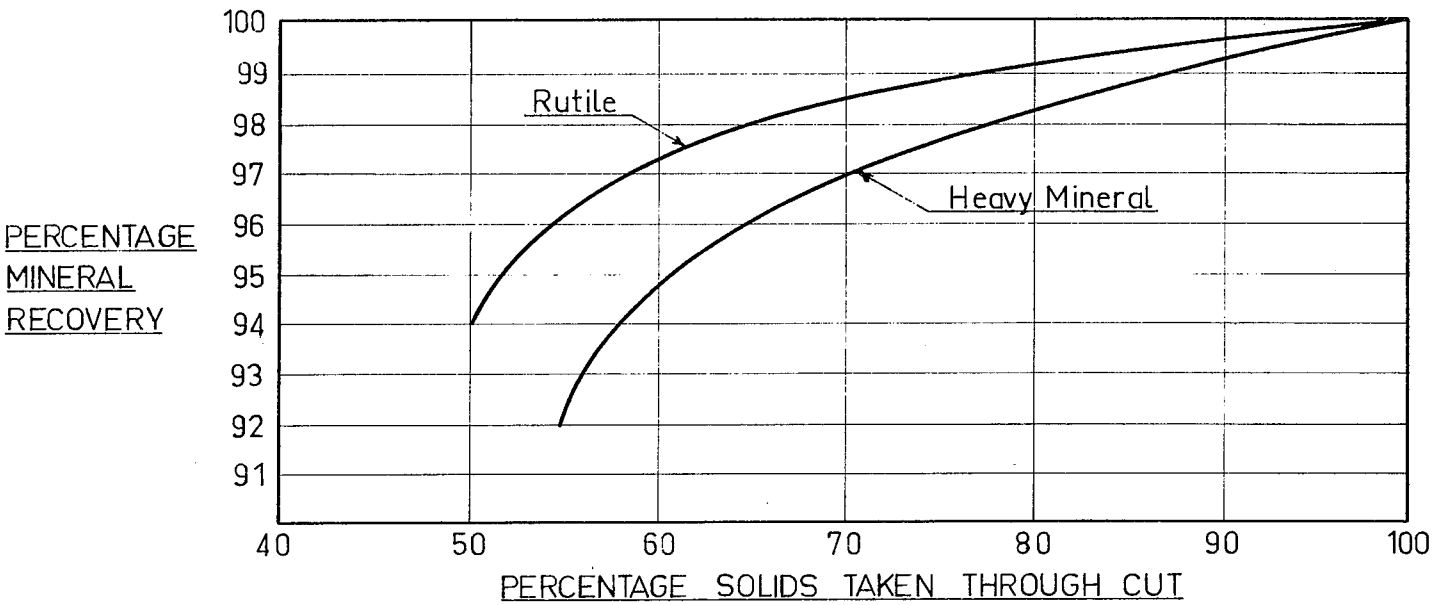
"FIG. 3 is a graph showing separation with apparatus.
Figure 4:
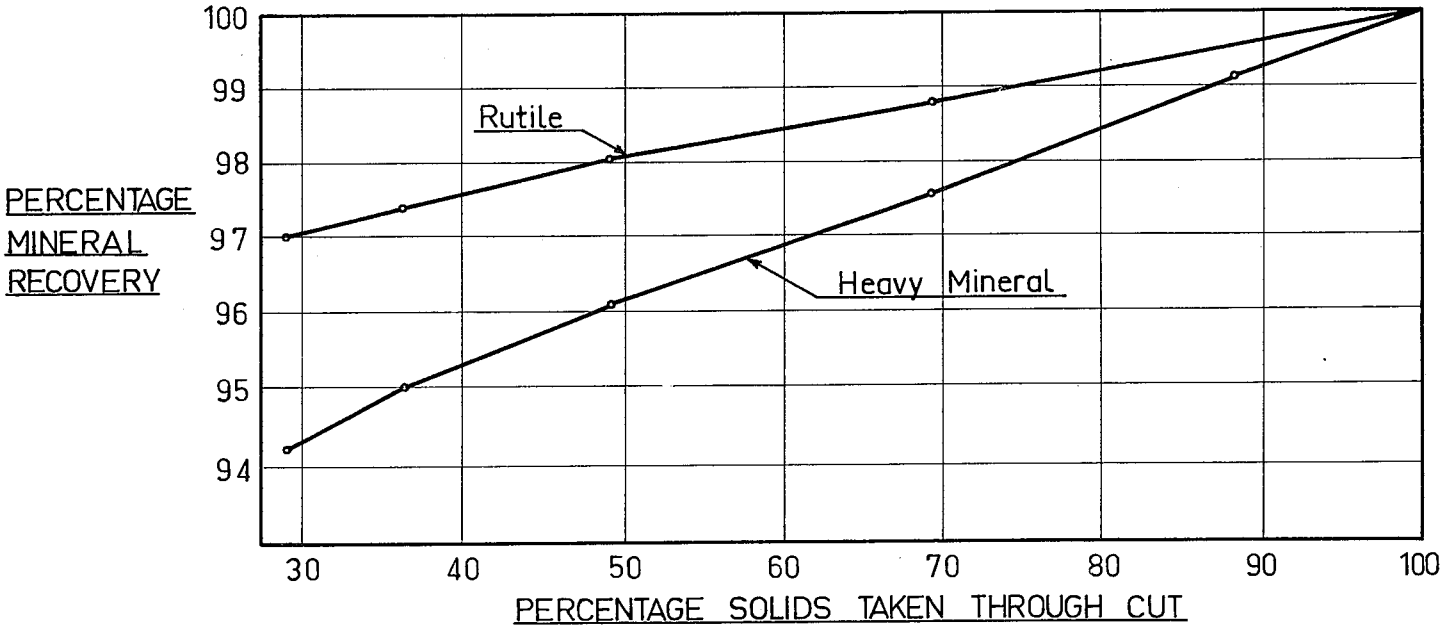
FIG. 4 is a graph showing separation with a coupled succession of sluices."

These results have been plotted in FIG. 3 in the accompanying drawings.

EXAMPLE 2

In this example four sluices were coupled, that is, four consecutive cuts were taken from a mineral-bearing sand as used in Example 1. A tailing was rejected from each sluice and the end cut from sluices 1, 2 and 3 respectively provided the head feed for sluices 2, 3 and 4.

Overall results are tabulated in Table "B" below.

TABLE "B"

| | % Solids Taken | % Heavy Mineral Recovered | % Rutile Recovered | % Zircon Recovered | % Magnetics Recovered | % Others Recovered | Head Feed Grade | Tons Per Hour |
|---|---|---|---|---|---|---|---|---|
| 1 | 24.97 | 91.51 | 93.01 | 98.86 | 89.89 | 64.87 | 6.94 | 8.28 |
| 2 | 26.11 | 89.04 | 92.26 | 95.01 | 89.45 | 50.09 | 4.30 | 8.17 |
| 3 | 26.38 | 89.86 | 93.72 | 95.71 | 89.85 | 53.79 | 3.94 | 8.30 |
| 4 | 27.03 | 87.85 | 92.22 | 93.64 | 87.46 | 65.26 | 5.34 | 6.87 |
| 5 | 27.72 | 93.30 | 96.96 | 98.06 | 92.56 | 69.39 | 3.98 | 7.24 |
| 6 | 29.13 | 94.08 | 96.98 | 97.97 | 92.68 | 77.33 | 8.48 | 8.44 |

Details for the sixth run are set out below:

8.44 TONS PER HOUR WITH GRADE 8.482% HEAVY MINERAL

| Sluice | % Solids | % Heavy Mineral Recovery | % Rutile Recovery |
|---|---|---|---|
| No. 1 | 69.33 | 97.54 | 98.72 |
| No. 2 | 70.99 | 98.46 | 99.25 |
| No. 3 | 74.36 | 98.91 | 99.38 |
| No. 4 | 79.59 | 99.08 | 99.56 |

| Overall Concentration | | | % Heavy Mineral Recovery | % Rutile Recovery |
|---|---|---|---|---|
| Concentrates | 29.13% | solids | 94.12 | 96.68 |
| | | grade | 27.408 | |
| Tails | 70.87% | solids | 5.88 | 3.02 |
| | | grade | 0.704 | |

ACCUMULATIVE RESULTS

| Sluice | % Solids | % Heavy Mineral Recovery | % Rutile Recovery |
|---|---|---|---|
| No. 1 | 69.33 | 97.54 | 98.72 |
| No. 2 | 49.22 | 96.04 | 97.98 |
| No. 3 | 36.60 | 94.99 | 97.37 |
| No. 4 | 29.13 | 94.12 | 96.98 |

It was found that the best results were obtained by taking the following percentage undercuts:

| | |
|---|---|
| No. 1 Sluice | 70% |
| No. 2 Sluice | 70% |
| No. 3 Sluice | 75% |
| No. 4 Sluice | 80% |

and by directing wash water towards the feed end of the second, third and fourth sluices rather than towards the discharge end. Graph "B" shows the curve obtained for recovery of heavy mineral and rutile when taking the above percentage of solids.

EXAMPLE 3

SEPARATOR ANGLE (i) A sluice identical to that used in Example 1 was used. Measurement of the angle formed by the separating plate and the underside of the sluice and solids taken gave the following results.

| Angle | Solids in Undercut |
|---|---|
| 86° | 70% |
| 70° | 55% |

Variation of the angle above and below the examples given varied the percentage of solids in the undercut either up or down, the percentage remaining substantially constant for a given angle notwithstanding considerable variation in the feed rate from 5.86 tons per hour to 8.44 tons per hour.

(ii) RESULTS FOR CONSTANT ANGLE 86°

| Tons per Hour | % Solids in Undercut | % Heavy Mineral Recovery | % Rutile Recovery |
|---|---|---|---|
| 5.86 | 70.65 | 97.42 | 98.90 |
| 6.29 | 69.66 | 97.11 | 99.03 |
| 7.24 | 68.46 | 97.22 | 98.67 |
| 8.17 | 70.50 | 97.29 | 98.30 |
| 8.28 | 70.25 | 97.07 | 97.64 |
| 8.30 | 67.93 | 97.60 | 98.88 |
| 8.44 | 69.33 | 97.54 | 98.72 |

EXAMPLE 4

FEED RATE

For a 5 feet 6 inches long sluice identical to that used in Example 1, the prior art suggested that "overloading" occurred at 6.70 tons per hour.

The following table shows that overloading when using the apparatus according to the invention on an identical tray would occur somewhere between 8.44 and 8.93 tons per hour.

TABLE "C"

| Tons Per Hour | % Solids in Undercut | % Heavy Mineral Recovery | % Rutile Recovery |
|---|---|---|---|
| 6.87 | 73.50 | 97.58 | 98.70 |
| 7.24 | 68.46 | 97.22 | 98.67 |
| 8.17 | 70.50 | 97.29 | 98.30 |
| 8.28 | 70.25 | 97.07 | 97.64 |

TABLE "C"-continued

| Tons Per Hour | % Solids in Undercut | % Heavy Mineral Recovery | % Rutile Recovery |
|---|---|---|---|
| 8.30 | 67.93 | 97.60 | 98.88 |
| 8.44 | 69.33 | 97.54 | 98.72 |
| 8.93 | 67.87 | 95.41 | 97.40 |
| 9.08 | 70.50 | 94.28 | 97.01 |
| 9.52 | 74.88 | 93.00 | 95.04 |

I claim:

1. A method of recovering a material from a fluid mixture containing said material comprising the steps of causing the fluid mixture to flow along a flow guide assembly which forms the mixture into a flowing bed of fluid having a substantially rectangular cross section, the bed progressively increasing in density of the material to be recovered from one end of the bed to the opposite end thereof; guiding and directing the fluid mixture to impinge against a substantially planar impingement fact at a velocity causing separation of the fluid mixture into two fractions, a first fraction passing downwardly through a slot in the floor of the flow guide assembly upstream of the impingement face, and collecting each fraction separately; and adjustably arranging the angle of attach of said impingement face relative to said fluid mixture flow to obtain separation in such preselected ratio of one fraction to the other that one fraction will contain a desired major portion of the material to be recovered.

2. A method of recovering heavy mineral from a fluid mixture containing heavy mineral by utilizing an inclined sluice tray along which the fluid mixture can flow by gravity, said tray having a separator plate near its downstream end, said plate having a substantially planar impingement face in the path of movement of said fluid mixture and said sluice tray having a slot in its floor immediately upstream from the impingement face through which the fluid mixture striking the impingement face can pass gravitationally, the fluid mixture flowing downwardly on the sluice tray having a substantially rectangular cross section and progressively increasing in density of the heavy mineral from top to bottom thereof, comprising the steps of causing the fluid mixture to impinge against said impingement face at a velocity so that an upper fraction of the mixture and a lower fraction thereof are separated and the lower fraction passes downwardly through said slot for collection and the upper fraction sprays upwardly from the sluice tray for collection separately from the lower fraction, and adjustably arranging the angle of attack of said impingement face relative to the fluid mixture flow to obtain such preselected ratio of upper and lower fractions that the lower fraction will contain a desired major portion of the heavy mineral.

* * * * *